United States Patent [19]

Kurahashi et al.

[11] Patent Number: 4,601,955

[45] Date of Patent: Jul. 22, 1986

[54] COMPOSITE MATERIAL FOR DECORATIVE APPLICATIONS

[75] Inventors: Kazuo Kurahashi; Nobutoshi Onodera, both of Hamamatsu, Japan

[73] Assignee: Nippon Gakki Seizo Kabushiki Kaisha, Japan

[21] Appl. No.: 756,029

[22] Filed: Jul. 17, 1985

[30] Foreign Application Priority Data

Jul. 26, 1984 [JP] Japan ..... 59-156386

[51] Int. Cl.[4] ..... C22C 1/09

[52] U.S. Cl. ..... 428/614; 428/608

[58] Field of Search ..... 428/614, 608

[56] References Cited

U.S. PATENT DOCUMENTS 4,205,119 5/1980 Young et al. ..... 428/614

4,499,156 2/1985 Smith ..... 428/614

FOREIGN PATENT DOCUMENTS 56-13780 3/1981 Japan ..... 428/614

*Primary Examiner*—Veronica O'Keefe

*Attorney, Agent, or Firm*—Lerner, David, Littenberg, Krumholz & Mentlik

[57] ABSTRACT

In construction of a composite material for decorative applications such as eyeglass frames, adjusted addition of whiskers to metal matrix provides the product with light weight, rich anticorrosion, high strength and, rich elasticity. Additional core-to-sheath cladding further improves workability without any influence on the light weight characteristics.

3 Claims, No Drawings

COMPOSITE MATERIAL FOR DECORATIVE APPLICATIONS

BACKGROUND OF THE INVENTION

The present invention relates to a composite material for decorative applications, and more particularly relates to improvements in the composition of a composite material used for decoration on fashionable articles such as watches and eyeglass frames.

Various Ti-base composite materials have been used for such decorative purposes, in which a metallic sheath is clad to Ti core of high strength, rich anticorrosion and light weight. For example, Ni or Ni-Cr alloy or Cu alloy sheath is clad to Ti or Ti-base alloy core. In another case, SiC fibers are used for the matrix.

In general, the property of light weight is required for a material being used for the above-described decorative purposes, in particular for eyeglass frames. The alloys used for the sheath in conventional composite materials all have a relatively large specific gravity and are low in mechanical strength. In order to obtain good workability and be adaptable to brazing and plating of a composite material, it is preferable to make the sheath as thick as possible. In terms of light weight, however, excess use of such a heavy sheath should be minimized. Light weight and high strength may be obtained by increased inclusion of Ti or Ti-base core, which results in poor workability of the product and therefore being unsuitable for intricate deformation in production of eyeglass frames. In the case of composite materials including SiC fibers, long SiC fibers have to be used for utmost utilization of high strength and elastic property of the fibers. Breakage of fibers often happens during production of such long SiC fibers and, as a consequence, it is almost infeasible to produce uniform long SiC fibers at high production efficiency.

SUMMARY OF THE INVENTION

It is the object of the present invention to enable production of a composite material for decorative applications which exhibits high strength, high elastic property with good adaptability to brazing and plating at high production efficiency.

In accordance with the first basic aspect of the present invention, a composite material includes 5 to 30% by volume of whiskers of 10 to 5000 aspect ratio dispersed in a matrix made of Ti, Ti-based alloy, Al or Al-base alloy.

In accordance with the second basic aspect of the present invention, a sheath made of Ni, Ni-base alloy, Cu or Cu base alloy is clad at 3 to 30% cross sectional surface ratio to a core which includes 5 to 30% by volume of whiskers of 10 to 5000 aspect ratio dispersed in a matrix made of Ti, Ti-base alloy, Al or Al-base alloy.

In accordance with the third basic aspect of the present invention, a sheath made of Au or Au-base alloy is clad at 2 to 15% cross sectional surface ratio to a core which includes 5 to 30% by volume of whiskers of 10 to 5000 aspect ratio dispersed in a matrix made of Ti, Ti-base alloy, Al or Al-base alloy.

DESCRIPTION OF THE PREFERRED EMBODIMENT

As described above, according to the first basic aspect of the present invention, a composite material includes 5 to 30% by volume of whiskers of 10 to 5000 aspect ratio dispersed in a matrix made of Ti, Ti-base alloy, Al or Al-base alloy.

As for the whiskers to be dispersed in the matrix, SiC whiskers, alumina whiskers, zirconium oxide whishers, $\alpha$ sialon whiskers, $\beta$ sialon whiskers and silica whiskers are preferably used.

When the aspect ratio falls below 10, no sufficient stress transmission is expected between the whiskers and the matrix, thereby lowering fortification by addition of the whiskers. When the aspect ratio exceeds 5000, the excessively long construction does not allow the whiskers to follow strain at plastic deformation, thereby causing breakage of fibrous components and, as a consequence, a lowering in strength.

Use of the above-described metals for the matrix assures light weight and rich corrosion suited for decorative application.

Any rate of inclusion below 5% by volume for the whiskers cannot assure rich fortification by the whiskers. Rate of inclusion above 30% by volume results in significant rise in strength which mars workability of the composite material.

Addition of the whiskers to the matrix enables production of a composite material having light weight and rich anticorrosion with high strength and elastic property suited for decorative applications. For example, if the composite material of the present invention is used for an eyeglass frame which is as strong as an eyeglass frame made of a conventional material, the weight of the product can be significantly reduced. As a consequence, freedom in designing the strength of the product can be enlarged. Further, by properly adjusting the rate of inclusion of the whiskers, the strength and/or elastic property of the product can be freely adjusted without any influence on light weight. Thus, use of the composite material in accordance with the present invention can accommodatee a wide variety of strength demands. Dispersed inclusion of the matrix does not hinder application of pressing, swaging and drawing to the composite material.

According to the second basic aspect of the present invention, a composite material includes a core which includes 5 to 30% by volume of whiskers of 10 to 5000 aspect ratio dispersed in a matrix made of one of Ti, Ti-base alloy, Al and Al-base alloy; and a sheath made of one of Ni, Ni-base alloy Cu and Cu-base alloy and clad at 3 to 30% cross sectional surface ratio to the core.

Presence of the sheath, in addition to the merits of the basic composite material, assures good adaptability to brazing and plating, and is therefore suited for decorative applications. The sheath covering the matrix is soft, ductile and allows smooth plastic deformation.

According to the third basic aspect of the present invention, a composite material includes a core which includes 5 to 30% by volume of whiskers of 10 to 5000 aspect ratio dispersed in a matrix made of one of Ti, Ti-base alloy, Al and Al-base alloy; and a sheath made of one of Au and Au-base alloy and clad at 2 to 15% cross sectional surface ratio to the core. Au or Au-base alloy is used for the sheath from deeper decorative consideration. The thickness of the sheath is too thin when the cross sectional surface ratio falls below 2%. Any cross sectional surface ratio exceeding 15% impairs the light weight of the product.

EXAMPLES

SiC whiskers were used whose diameter was in a range from 0.01 to 1.0 μm, length was in a range from 10 to 100 μm and ρB was in a range from 400 to 700 kg/mm$^2$. The whiskers were mixed with Ti powder at rates of inclusion (% by volume) shown in Table 1, and each mixture was encased in a rubber container which was then subjected to hydrostatic extrusion at 5000 kg/cm$^2$ pressure in order to make a rod of 35 mm diameter and 300 mm length. Next the diameter was reduced to 30 mm and the length to 100 mm by cutting. The rod was then inserted into a Ni tube of 3 mm thickness and its ends were closed by electronic beam welding. The combination was subjected to hot extrusion at 750° to 800° C. temperature to form a wire of 5 mm diameter. The wire was then subjected to annealing at 700° C. for 1 hour in a $H_2$ gas environment and subsequent wire drawings at 8% deformation rate for each pass in order to form a wire of 2.6 mm diameter which was in turn subjected to annealing at 700° C. for 1 hour in a $H_2$ gas environment in order to form a test piece. The test pieces Nos. 11 to 18 in Table 1 were prepared in this manner. The cross sectional surface ratio for Ni was 3%.

TABLE 1

| Sample No. | mechanical properties Strength (kg/mm$^2$) | Elongation (%) | SiC inclusion (% by volume) | specific gravity | Press pressure (Ton) | Width (mm) | Remark |
|---|---|---|---|---|---|---|---|
| 1 | 51 | 23 | 0 | 4.51 | 80 | 4.9 | Workable |
| 2 | 59 | 21 | 3 | 4.46 | 82 | 4.9 | |
| 3 | 71 | 18 | 7 | 4.42 | 100 | 4.9 | |
| 4 | 80 | 12 | 10 | 4.38 | 120 | 5.0 | |
| 5 | 90 | 10 | 15 | 4.31 | 131 | 4.9 | |
| 6 | 126 | 3 | 20 | 4.24 | 172 | 4.7 | |
| 7 | 134 | 1 | 25 | 4.17 | 207 | 4.7 | |
| 8 | 151 | 0.8 | 30 | 4.10 | 223 | 4.6 | |
| 9 | 181 | 0.3 | 35 | 4.03 | 257 | fine cracks | not Workable |
| 10 | 192 | 0.1 | 40 | 3.96 | 293 | cracks | |
| 11 | 49 | 28 | 0 | 4.64 | 78 | 5.0 | Workable |
| 12 | 58 | 24 | 3 | 4.60 | 80 | 5.0 | |
| 13 | 65 | 20 | 7 | 4.55 | 98 | 4.9 | |
| 14 | 73 | 14 | 10 | 4.51 | 111 | 4.9 | |
| 15 | 83 | 12 | 15 | 4.44 | 127 | 4.9 | |
| 16 | 115 | 5 | 20 | 4.37 | 169 | 4.7 | |
| 17 | 139 | 1.0 | 30 | 4.23 | 220 | 4.7 | |
| 18 | 170 | 0.6 | 35 | 4.16 | 255 | 4.6 | |

In the above-described manner of preparation, insertion into a Ni tube and end closing were omitted in preparation of the test pieces Nos. 1 to 10 in Table 1. The test pieces Nos. 1 to 18 were all compressed down to 1.0 mm height on a press machine and generation of cracks was observed as shown in Table 1.

It is clear from the results shown in Table 1 that, in the case of test pieces Nos. 1 to 10 which include no Ni sheath, generation of cracks prevents smooth working when the rate of inclusion of SiC whiskers is 35% or larger. In the case of test pieces Nos. 11 to 18 which include Ni sheaths, no cracks are generated even when the rate of inclusion of SiC whiskers is 35% or larger. This indicates the fact that the presence of the Ni sheath greatly improoves workability of the test pieces. The larger the rate of inclusion of SiC whiskers, the higher the strength and the smaller the specific gravity. It is clear from the results that the strength and elasticity of the product can be freely adjusted without any influence on light weight by change in the rate of inclusion of SiC whiskers.

Using test pieces shown in Table 1, eyeglass frames were produced as shown in Table 2 in consideration of strength required in practical use. Nickel silver was used for hinges.

TABLE 2

| Sample No. | Weight (g) | Rate of light weight (%) | Remarks |
|---|---|---|---|
| 1 | 12.1 | 41 | Ti only |
| 3 | 12.1 | 41 | SiC whisker fortification ↓ |
| 5 | 10.9 | 47 | |
| 6 | 10.7 | 48 | |
| 8 | 10.3 | 50 | |
| 11 | 12.3 | 40.6 | Ni sheath ↓ |
| 12 | 12.1 | 41 | |
| 14 | 12.0 | 42 | |
| 15 | 11.9 | 43 | |
| 18 | 10.1 | 51 | |
| | 20.7 | — | Comparative example Ni—Cr alloy |

In Table 2, the term "rate of light weight" for each test piece refers to the percentage of reduction in weight with respect to the weight of the comparative example. When test piece No. 3 is compared with test piece No. 15 which is almost the same in specific gravity as test piece No. 3, the rate of light weight is larger for the latter. This is due to improvement in workability and adaptability to brazing caused by presence of the sheath. Same applies to the comparison between test pieces Nos. 1 and 4 and test pieces Nos. 8 and 18.

Data in Table 2 clearly indicate that use of the composite material in accordance with the present invention assures 40 to 50% reduction in weight when compared with an eyeglass frame made of Ni-Cr alloy, the comparative example.

We claim:

1. A composite material for decorative applications comprising a core including whiskers dispersed in a matrix selected from the group consisting of Ti, Ti-base alloys, Al and Al-base alloys, said whiskers present in the range of from 5 to 30% by volume and having an aspect ratio in the range of from 10 to 5000, and a sheath clad to said core and having a cross-sectional surface ratio in the range of from 3 to 30%, said sheath selected from the group consisting of Ni, Ni-base alloys, Cu and Cu-base alloys.

2. A composite material for decorative applications comprising a core including whiskers dispersed in a matrix selected from the group consisting of Ti, Ti-base alloys, Al and Al-base alloys, said whiskers present in the range of from 5 to 30% by volume and having an aspect ratio in the range of from 10 to 5000, and a sheath clad to said core and having a cross-sectional surface ratio in the range of from 2 to 15%, said sheath selected from the group consisting of Au and Au-base alloys.

3. The composite material according to claim 1 or 2 wherein said whiskers are selected from the group consisting of SiC whiskers, alumina whiskers, zirconium oxide whiskers, $\alpha$ sialon whiskers, $\beta$ sialon whiskers and silica whiskers.

* * * * *